US005751279A

United States Patent [19]

Okumura

[11] Patent Number: 5,751,279

[45] Date of Patent: May 12, 1998

[54] ACTIVE MATRIX TYPE LIQUID CRYSTAL DISPLAY AND METHOD DRIVING THE SAME

[75] Inventor: Fujio Okumura, Tokyo, Japan

[73] Assignee: NEC Corporation, Tokyo, Japan

[21] Appl. No.: 784,313

[22] Filed: Jan. 16, 1997

Related U.S. Application Data

[63] Continuation of Ser. No. 680,553, Jul. 9, 1996, abandoned, which is a continuation of Ser. No. 452,702, May 30, 1995, abandoned, which is a continuation of Ser. No. 92,062, Jul. 16, 1993, abandoned.

[30] Foreign Application Priority Data

Jul. 16, 1992 [JP] Japan ..... 4-188518

[51] Int. Cl.[6] ..... G09G 3/30

[52] U.S. Cl. ..... 345/212; 345/90; 345/204

[58] Field of Search ..... 345/204–206, 345/212, 90, 92, 98, 100, 101; 349/19, 41, 42; 307/491

[56] References Cited

U.S. PATENT DOCUMENTS

| | | | |
|---|---|---|---|
| 4,377,759 | 3/1983 | Ohhata et al. | 307/491 |
| 4,820,023 | 4/1989 | Ohsawa | 359/85 X |
| 5,091,722 | 2/1992 | Kitajima et al. | 345/90 X |
| 5,191,455 | 3/1993 | Hashimoto et al. | 359/85 |
| 5,457,474 | 10/1995 | Ikeda | 345/92 |
| 5,510,748 | 4/1996 | Erhart et al. | 345/204 |
| 5,532,719 | 7/1996 | Kikinis | 345/212 |
| 5,576,737 | 11/1996 | Isozaki | 345/212 |
| 5,585,814 | 12/1996 | Ueno et al. | 345/90 |

OTHER PUBLICATIONS

Hayashi et al., "Fully Integrated Poly–Si CMOS LCD with Redundancy", Proceedings of Eurodisplay '90, pp. 60–63.

*Primary Examiner*—Amare Mengistu

*Attorney, Agent, or Firm*—Sughrue, Mion, Zinn, Macpeak & Seas, PLLC

[57] ABSTRACT

An active matrix type liquid crystal display includes a groups of gate lines and a group of data lines with each of the gate lines and each of the data lines crossing with each other in a matrix form, a video signal generating circuit for generating a video signal, a plurality of detection circuits for measuring voltage fluctuations on the data lines, a reference voltage supply circuit for supplying a reference voltage to each of the data lines, a memory for storing the voltage fluctuations for pixels of at least one scanning line, and a circuit for combining the voltage fluctuations stored in the memory to the video signal from the video signal generating circuit. Each of the detection circuits is connected to each of the data lines, and the reference voltage supply circuit is formed by a variable voltage source and an analog switch connected to the data lines. The offset in the output voltages of data line drive ICs and thin film transistor drive circuits, which have heretofore been difficult to measure, can be measured accurately, and by correcting the offset, it is possible to realize a high gradation active matrix liquid crystal display.

3 Claims, 9 Drawing Sheets

ACTIVE MATRIX TYPE LIQUID CRYSTAL DISPLAY AND METHOD DRIVING THE SAME

This is a Continuation of application Ser. No. 08/680,553, filed Jul. 9, 1996 now abandoned, which is a Continuation of application Ser. No. 08/452,702 filed May 30, 1995 now abandoned, which is a Continuation of application Ser. No. 08/092,062, filed Jul. 16, 1993, and now abandoned.

BACKGROUND OF THE INVENTION (1) Field of the Invention

The present invention relates to an active matrix type liquid crystal display, in which thin film transistors each provided for each pixel serve as active switches, and a method of driving such active matrix type liquid crystal display.

(2) Description of the Related Art

A conventional active matrix type liquid crystal display is first explained with reference to FIGS. 8–10. FIG. 8 shows an equivalent circuit of a panel section of a prior art active matrix type liquid crystal display. This example uses non-crystalline silicon thin film transistors as active elements. As shown, it mainly comprises a pixel section having elements 803 to 807, a plurality of, gate line drive ICs 802 and a plurality of data line drive ICs 801. The equivalent circuit of the pixel section usually comprises a data line 803, a gate line 804, a non-crystalline silicon thin film transistor 805, a liquid crystal capacitor 806 and an opposing electrode 807 on a back substrate.

An externally inputted video signal is inputted to the data line drive ICs 801 where the signal corresponding to one scanning line is stored at a sample/hold circuit. Then, as the gate line drive ICs 802 access the gate lines 804 successively, the video signal is collectively outputted to the data lines 803. At this time, each thin film transistor 805 connected to the accessed gate line is turned on, whereby the signal is written in the related liquid crystal capacitor 806.

Generally, the liquid crystal display has a considerably large number of gate and data lines. In addition, both these different lines respectively require pluralities of their drive ICs as shown in FIG. 8. As an example, a color liquid crystal display for a certain personal computer requires 400 gate lines and 1,920 data lines. As for the drive IC, those having about 120 or 190 outputs are used. This means that 10 to 20 data line drive ICs are necessary, while requiring several, perhaps, three or four, gate line drive ICs.

The data line drive IC has a specific structure as shown in FIG. 9. Illustrated in FIG. 9 is an equivalent circuit for one data line. Referring to FIG. 9, designated at 901 is a video signal line, at 902 and 903 sampling analog switches, at 904 and 905 capacitors for holding signal, at 906 and 907 analog switches for selecting output to data line, and at 908 a buffer amplifier, the output of which is coupled to a data line 909. Designated at 910 is a gate line in the pixel section, at 911 a thin film transistor, at 912 a liquid crystal capacitor, and at 913 an opposing electrode. As is seen, the sample/hold mechanism is dual, because it is necessary to successively store signal of each scanning line while outputting signal of the immediately preceding scanning line.

FIG. 9 shows a state, in which the analog switch 907 is "on", thus outputting signal stored in the capacitor 905. In this state, with the appearance of data line timing signal corresponding to the next scanning line on the video signal line 901, the analog switch 902 is momentarily turned on, whereby the signal is taken in the capacitor 904. Upon the succeeding scanning line output timing being reached, the analog switch 906 is turned on while the analog switch 907 is turned off, thus switching the outputs. The above sequence of operations is iterated to output signal.

While the above example uses the non-crystalline thin film transistors, various schemes using polycrystalline silicon thin film transistors are being investigated, developed and put to practical use. This type of transistor is used because it is capable of high speed operation and also because it permits integration of peripheral drive circuits such as the above gate and data line drive ICs with thin film transistors. Currently, it is applied in an fully integrated drive circuit form to video camera view finders and liquid crystal light bulbs in liquid crystal projectors.

FIG. 10 outlines a circuit structure, which is described in "Fully Integrated Poly-Si CMOS LCD with Redundancy", by Hayashi et al, in Proceedings of Eurodisplay '90, p-p. 60–63.

Referring to FIG. 10, designated at 1001 and 1002 are respectively a data and a gate line drive circuit comprising thin film transistors, at 1003 analog switch groups, at 1004 a red, a green and a blue (RGB) video signal line, at 1005 gate lines each for on-off operating each analog switch group 1003 comprising three analog switches, and 1006 and 1007 respectively data and gate lines, and at 1008 a pixel section. As is seen from comparison to FIG. 9, the data line drive section has a structure comprising sole analog switches instead of the sample/hold circuit. This means that, unlike the previous example, one scanning line data is not written collectively but is written successively whenever an analog switch is turned on.

In the above prior art, a problem is posed by video signal fluctuations due to offsets in the outputs of the data line drive ICs or thin film transistor drive circuits. Currently, the output of the final stage buffer amplifier in the above data line drive IC contains a voltage offset of ±50 to ±150 mv. The offset is mainly an offset introduced by the amplifier itself, but there is also, to a slight extent, an offset due to feed-through noise from the analog switch group. Therefore, there are output sways in this range. As noted above, a liquid crystal display requires a plurality of drive ICs as noted above, and there are great signal fluctuations particularly with the individual ICs. For example, even if an IC is subject to signal fluctuations only within ±50 mV, its standard fluctuation value is different from those of other ICs, and therefore the overall fluctuation may amount to ±150 mV.

The TN (Twisted Nematic) liquid crystal which is extensively applied to current active matrix type liquid crystal displays, has a threshold value of about 2 V and a gradation control range of 1 to 3 V. Therefore, the fluctuation range of ±150 mV reduces the controllable gradation number to 3 to 10. This is visually perceived as great fluctuations with the individual gate line drive ICs. Specifically, a vertical stripe pattern is recognized. Commercially, however, a large gradation number such as 258 is required as in HDTV (High Definition Television). Such a large gradation number cannot be attained with the above performance of drive IC.

To solve this problem, voltage offset control by IC selection is in practical use. This measure, however, requires high cost for the operation of IC selection. Besides, even by selecting ICs, it is usually possible to hold the fluctuations within only ±50 mV, and the obtainable gradation number is only 10 to 30, which is very far from the necessary value of 256.

The situation involved is further serious in the case of polycrystalline silicon. As noted above, the prior art example, in which polycrystalline silicon thin film transistors are integrated, does not use any sample/hold circuit but uses mere analog switches. This is so because the polycrystalline silicon thin film transistors in the pixel section are capable of high speed operation and can take in signal quickly. In addition, since almost all applications are for small size active matrix type liquid crystal displays such as view finders for handy cameras, there is no signal delay on the data line, and driving thereof is possible without provision of any buffer amplifier. A further reason of use of analog switches, however, is the difficulty of forming an amplifier having a small voltage offset. The fluctuations of characteristics of polycrystalline silicon thin film transistors are greater by more than one order of the magnitude than those of usual field effect transistors formed on monocrystalline silicon wafers. Therefore, where amplifiers are formed, the offset amounts to 1 V in a worse case. The provision of amplifiers, however, is essential in large size panels. For the above reasons, in the prior art it has been very difficult to obtain a desired gradation number.

SUMMARY OF THE INVENTION

An object of the invention is to provide an active matrix type liquid crystal display, in which output voltage offset fluctuations of data line drive ICs or thin film transistor drive circuits are small, and which can realize high gradation display, and also a method of driving such a display.

According to one aspect of the invention, there is provided an active matrix type liquid crystal display comprising:

a first and a second insulating substrate with a liquid crystal sandwiched therebetween;

a plurality of liquid crystal capacitors each having a pixel electrode formed on the first insulating substrate and an opposing electrode formed on the second insulating substrate;

a group of gate lines and a group of data lines with each of the gate lines and each of the data lines crossing with each other in a matrix form on the first insulating substrate;

a plurality of thin film transistors provided at intersections of the gate and data lines, each of the thin film transistors having a gate electrode connected to one of the gate lines, a drain electrode connected to one of the data lines and a source electrode connected to the pixel electrode of the liquid crystal capacitor;

a gate line drive circuit connected to the gate lines, for generating successive gate pulses;

a data line drive circuit connected to the data lines, for outputting a video signal to the data lines;

a video signal generating circuit connected to the data line drive circuit, for generating the video signal supplied to the data line drive circuit;

a plurality of detection circuits each connected to each of the data lines, for measuring voltage fluctuations on the data lines;

a plurality of reference voltage supply circuits each for supplying a reference voltage to each of the data lines, each of the reference voltage supply circuits being formed by a variable voltage source and an analog switch connected to the data line;

a memory for storing the voltage fluctuations for pixels of at least one scanning line; and a circuit for combining the voltage fluctuations stored in the memory to the video signal from the video signal generating circuit.

According to another aspect of the inventions there is also provided a method of driving an active matrix type liquid crystal display having a detection circuit, a reference voltage supply circuit and a data line drive circuit, all of which are connected to data lines, and a video signal generating circuit which is connected to the data line drive circuit, the method comprising the steps:

inputting a voltage to the detection circuit from the reference voltage supply circuit;

calibrating the detection circuit by reading the voltage with the detection circuit;

detecting an offset generated in the data line drive circuit with the detection circuit by using the result of the calibration;

storing the offset in a memory; and superimposing the offset on a video signal from the video signal generating circuit.

BRIEF DESCRIPTION OF THE DRAWINGS

The above and other objects, features and advantages of the present invention will be apparent from the following description of preferred embodiments of the invention explained with reference to the accompanying drawings, in which.

PREFERRED EMBODIMENTS OF THE INVENTION

Now, an active matrix type liquid crystal display and method of driving the same according to the embodiments of the invention will be described with reference to the accompanying drawings.

Figure 1:
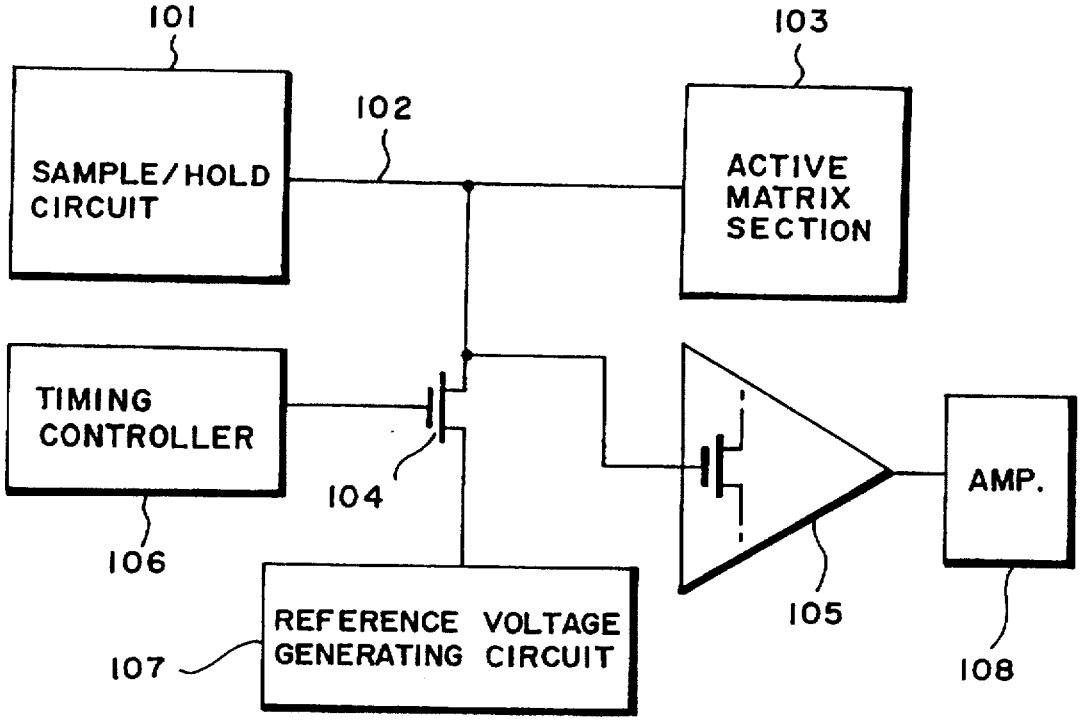
FIG. 1 is a diagram showing an example of offset voltage detection section of a data line drive circuit in an active matrix type liquid crystal display embodying the invention.
Figure 2:
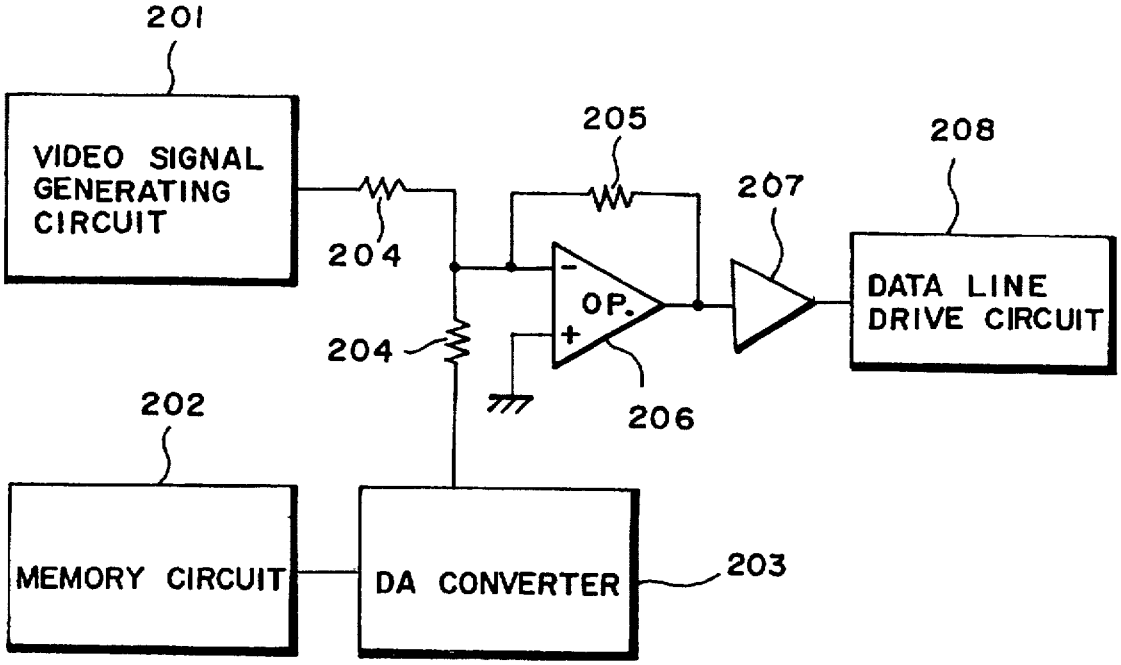
FIG. 2 is a diagram showing an example of video signal compensating section in the active matrix type liquid crystal display according to the invention.
Figure 3:
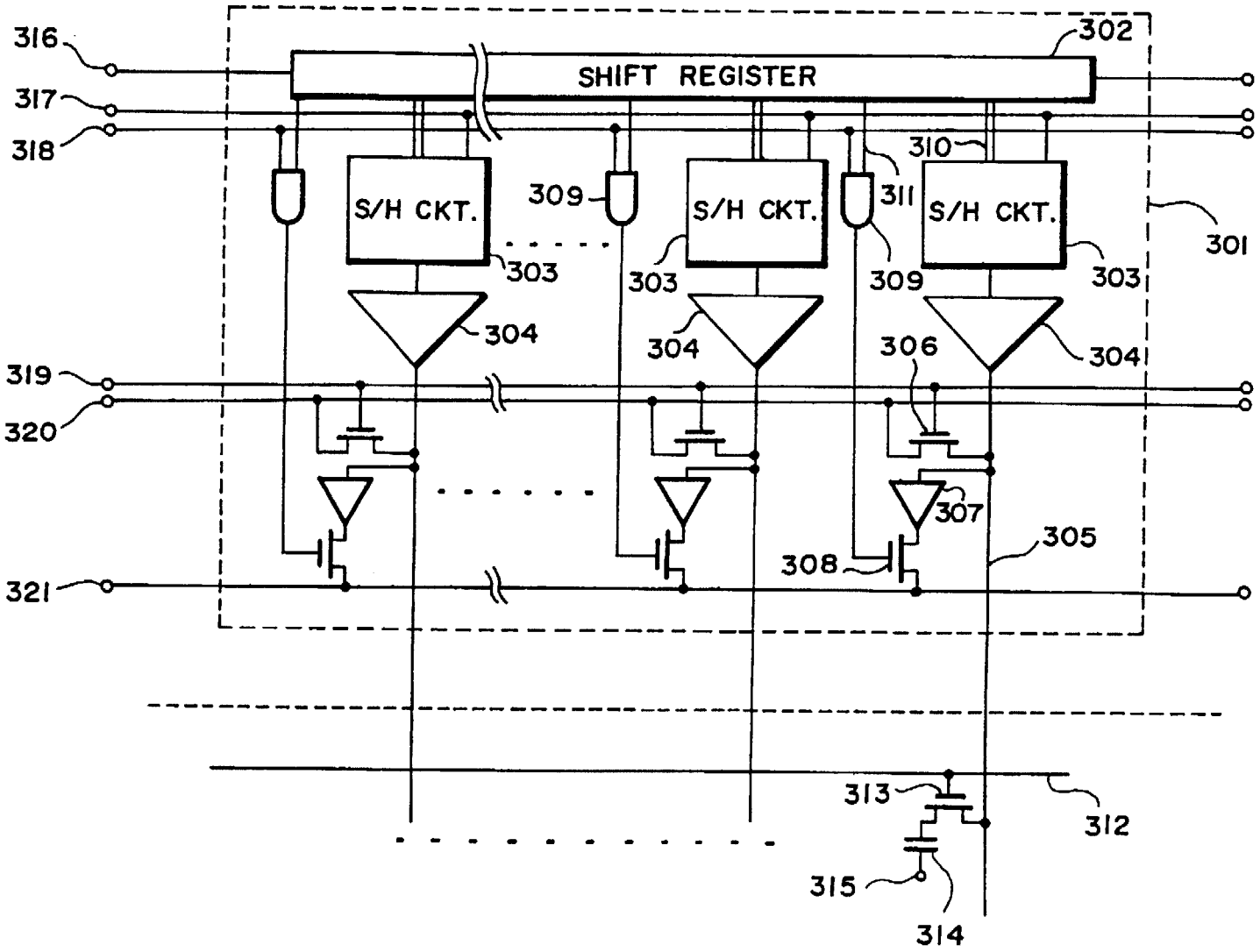
FIG. 3 is a diagram showing an arrangement wherein an offset detection circuit according to the invention is provided in each data line, drive IC.
Figure 4:
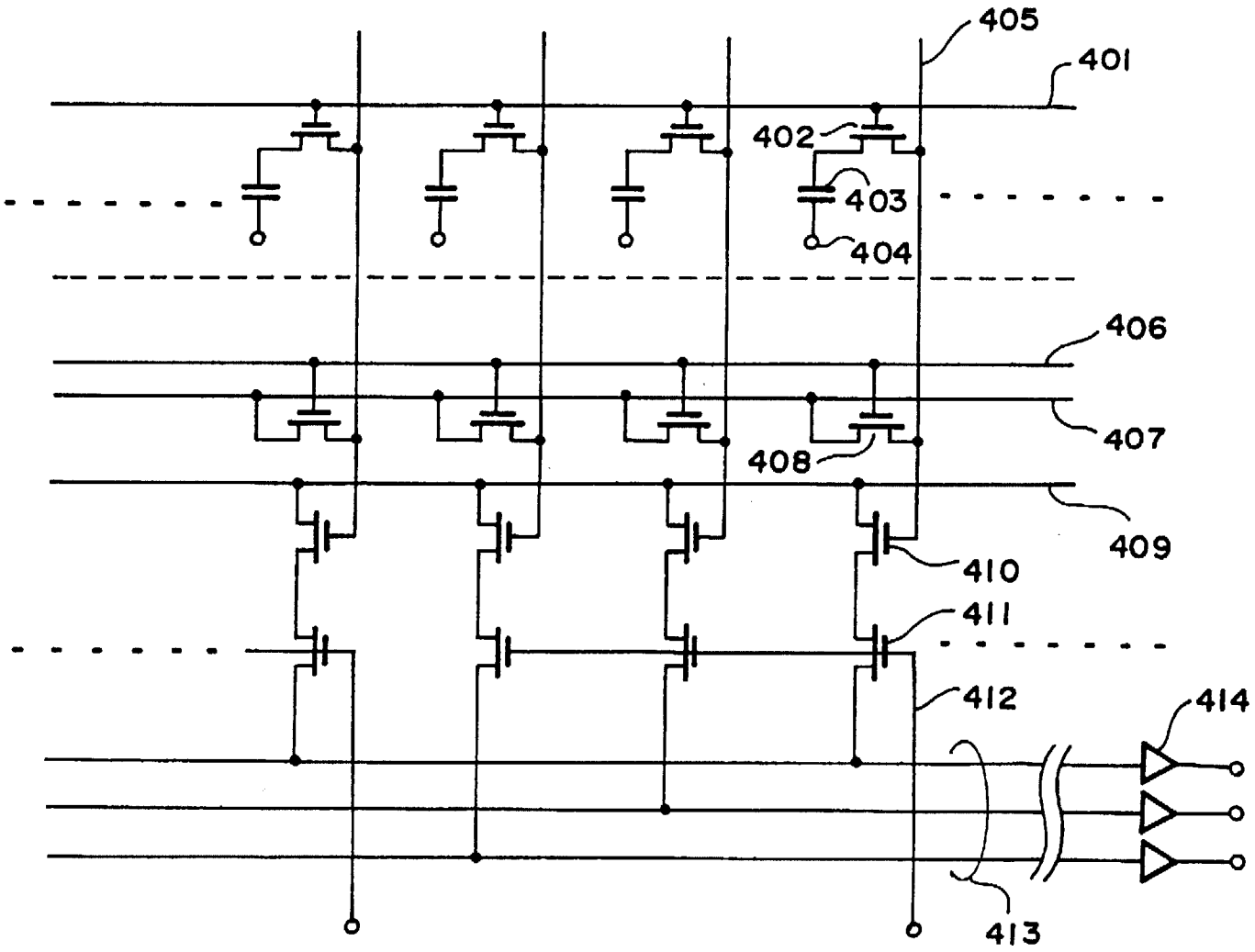
FIG. 4 is a diagram showing an arrangement according to an embodiment of an offset measurement section constituted by thin film transistors according to the invention.
Figure 5:
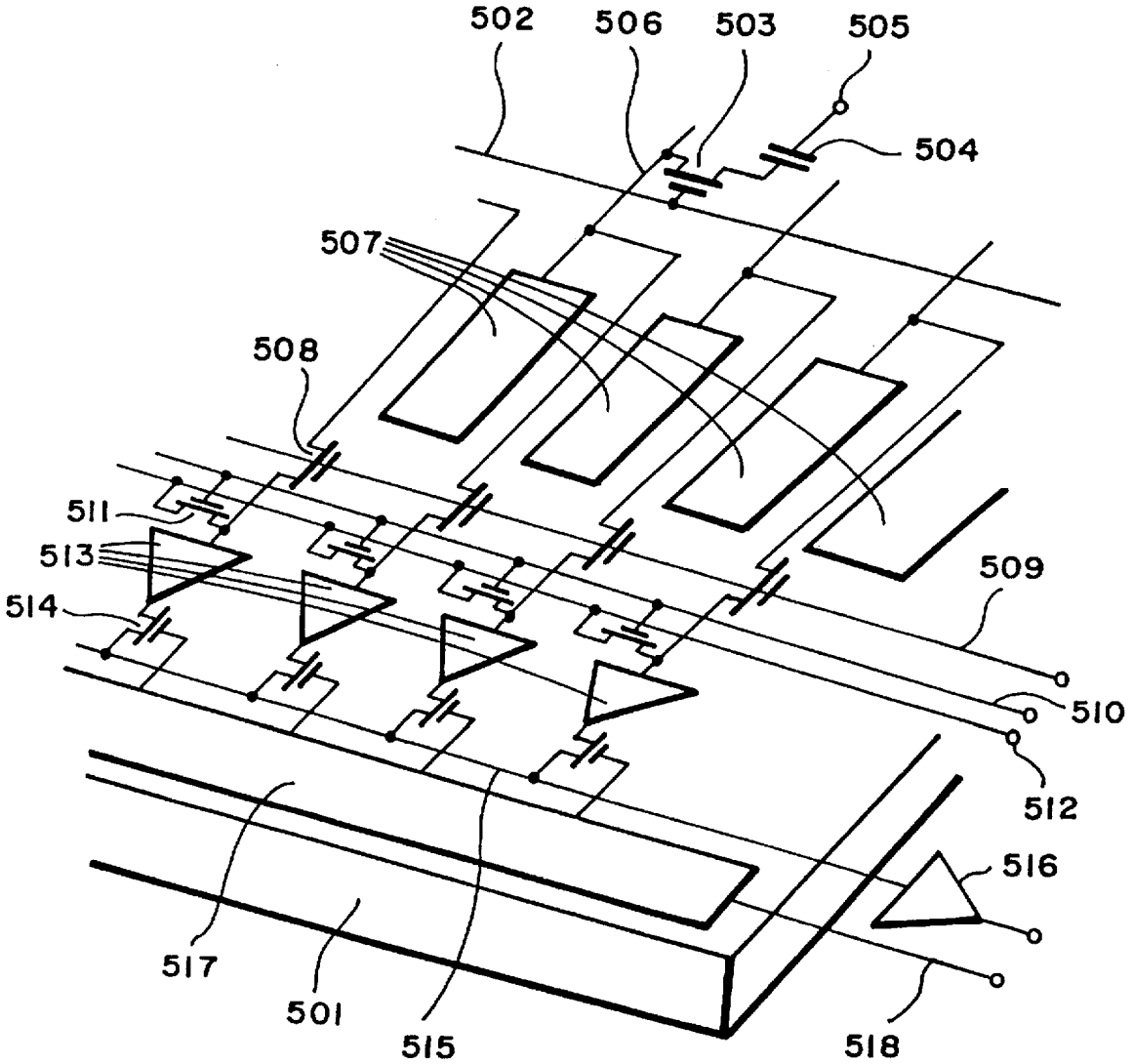
FIG. 5 is a diagram showing an arrangement according to another embodiment of the offset measurement section constituted by thin film transistors according to the invention.
Figure 6:
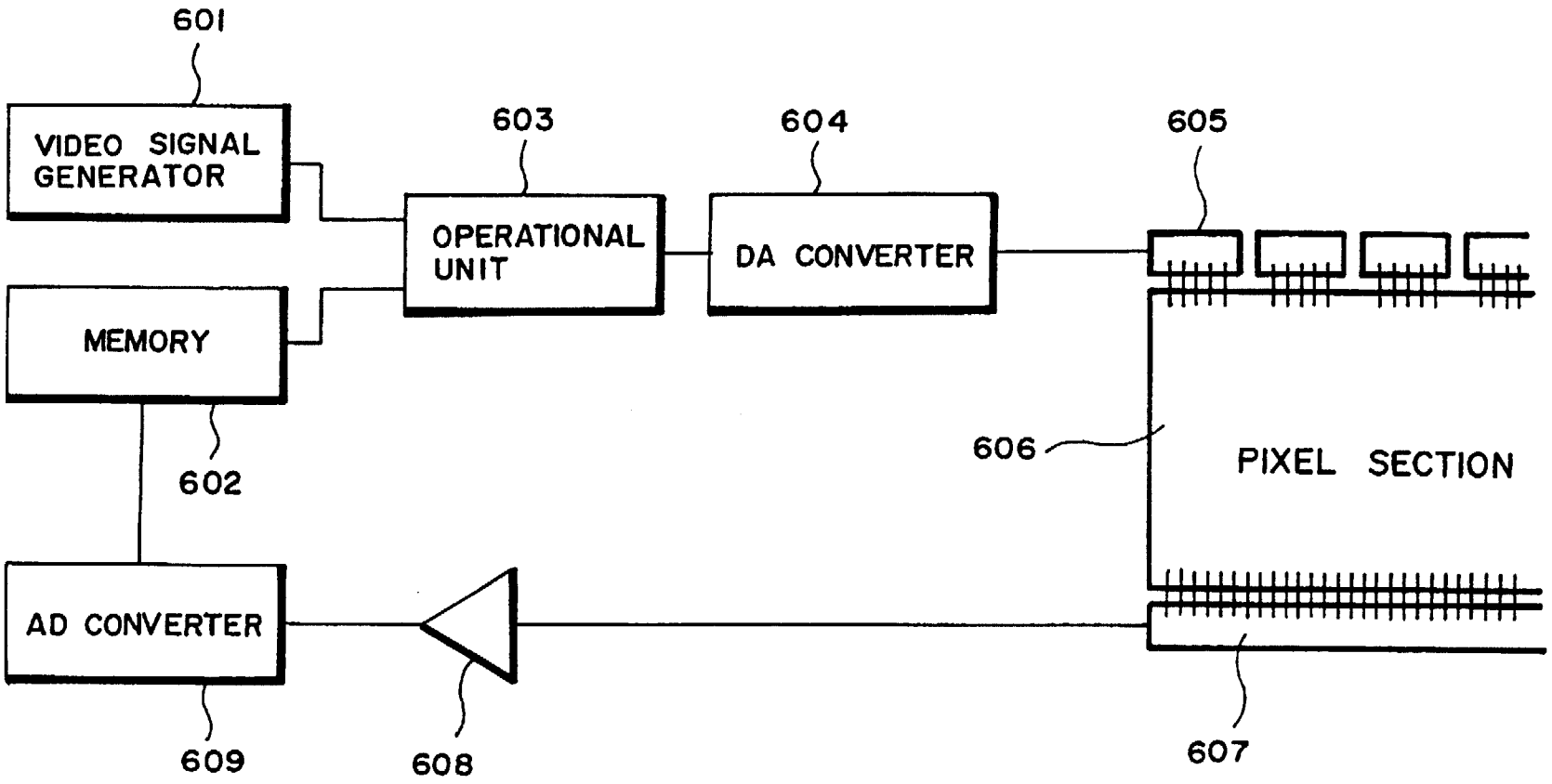
FIG. 6 is a diagram showing a voltage correction circuit according to the invention.

FIGS. 1 and 2 schematically show an example of offset voltage detector and an example of video signal compensator, respectively, of the data line drive circuit in an active matrix type liquid crystal display embodying the present invention. FIGS. 3–5 show exemplary circuits to assist in understanding the circuit of FIG. 1. Similarly, FIG. 6 provides an exemplary circuit to assist in understanding the circuit of FIG. 2.

Referring to FIG. 1, designated at 101 is a sample/hold circuit of a data line driver, at 102 a data line, at 103 an active matrix section, at 104 an analog switch for supplying a reference voltage, at 105 a voltage measurement circuit, at 106 a timing controller for controlling the operation timing of the analog switch 104, at 107 a reference voltage generator, and at 108 an amplifier.

The sample/hold circuit 101 is the final stage of a usual data line drive circuit. Its output offset is again a problem. The offset causes voltage fluctuations in the video signal supplied to the active matrix section 103.

The voltage measurement circuit 105 is provided on each data line 102 for accurately measuring the offset of output from the data line drive circuit. However, the voltage measurement circuit 105 itself has the problems of fluctuations of the offset and of the amplification factor. Therefore, the measurement of the offset is meaningless unless the characteristics of the voltage measurement circuit 105 are grasped. To this end, in this example, a reference voltage is supplied from the reference voltage generator 107 through the analog switch 104 for supplying the reference voltage, which is connected to the data line. If only one reference voltage generator is commonly provided as a variable voltage source for all the data lines, it can serve as an absolute reference for the calibration of the voltage measurement circuits.

By using the voltage measurement circuit which is calibrated in the above way, it is possible to measure not only the offset value but also transmission distortions in the sample/hold circuit. Usually, sufficient gradations are obtainable with mere offset correction, but the distortions noted above may also be corrected in the case where high quality picture is required.

In the process described above, the calibration is done prior to the measurement. However, for the offset measurement, it is possible to read the data line offset with a voltage measurement circuit having unknown characteristics and then provide a reference voltage. In this case, the reference voltage applied later is regarded as the offset, which reference voltage causes the output of the voltage measurement circuit to the same voltage where the data line offset has been read without being applied with the reference voltage. This method of calibration has an advantage that there is no need of storing any calibration data for the voltage measurement circuit.

The offset is then corrected by using the offset data thus obtained. Referring to FIG. 2, designated at 201 is a video signal generator, at 202 a voltage variation memory, at 203 a digital-to-analog (DA), converter, at 204 an input resistor, at 205 a feedback resistor, at 206 an operational amplifier, at 207 an inversion amplifier, and at 208 a data line drive circuit.

The signal from the video signal generator 201 and that from the voltage variation memory 202 are combined to obtain a resultant signal which is inputted to the data line drive circuit 208. That is, the stored voltages from the memory 202 are superimposed on the video signal from the video signal generator 201. In this case, the offset is stored digitally and as a negative data. This data is converted by the DA converter 203 into an analog signal which is synthesized with the video signal by an amplifier formed by the input resistors 204, the feedback resistor 205 and the operational amplifier 206. This amplifier for synthesizing performs inverse amplification, and therefore the inversion amplifier 207 is provided to restore positive signal.

The offset is stored as a negative data since the offset is subtracted from the video signal at the time of the synthesis. While in this example two inversion amplifiers are used, it is possible to use only one single inversion amplifier by having the video signal and offset data inverted in advance.

In the prior art, there was no such technique and, therefore, it was difficult to correct signal. The difficulty of measurement stems from various reasons. One of the reasons is that it is very difficult to provide measurement terminals on all the data lines because of very high density of wiring. Another reason is that, even if it were possible to provide such terminals, the accuracy of measurement would be reduced by the influence of the input impedance of a measurement probe. A further reason is that the measurement system itself may have an offset.

Figure 9:
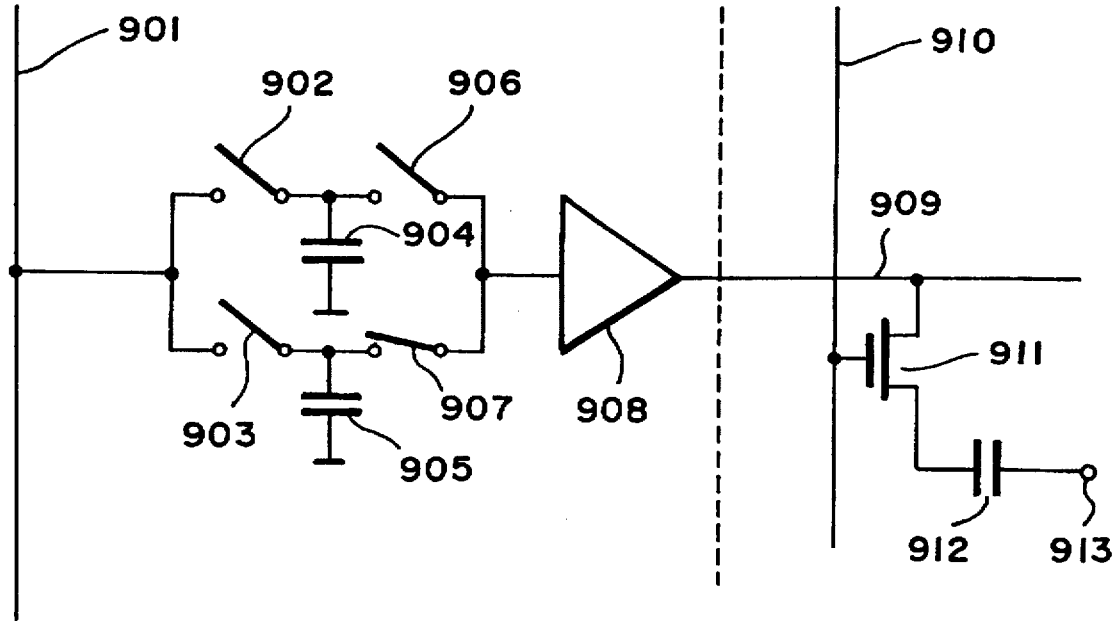
FIG. 9 PRIOR ART
FIG. 9 is a diagram showing a sample/hold circuit section of a data line drive IC in a prior art active matrix type liquid crystal display.
Figure 10:
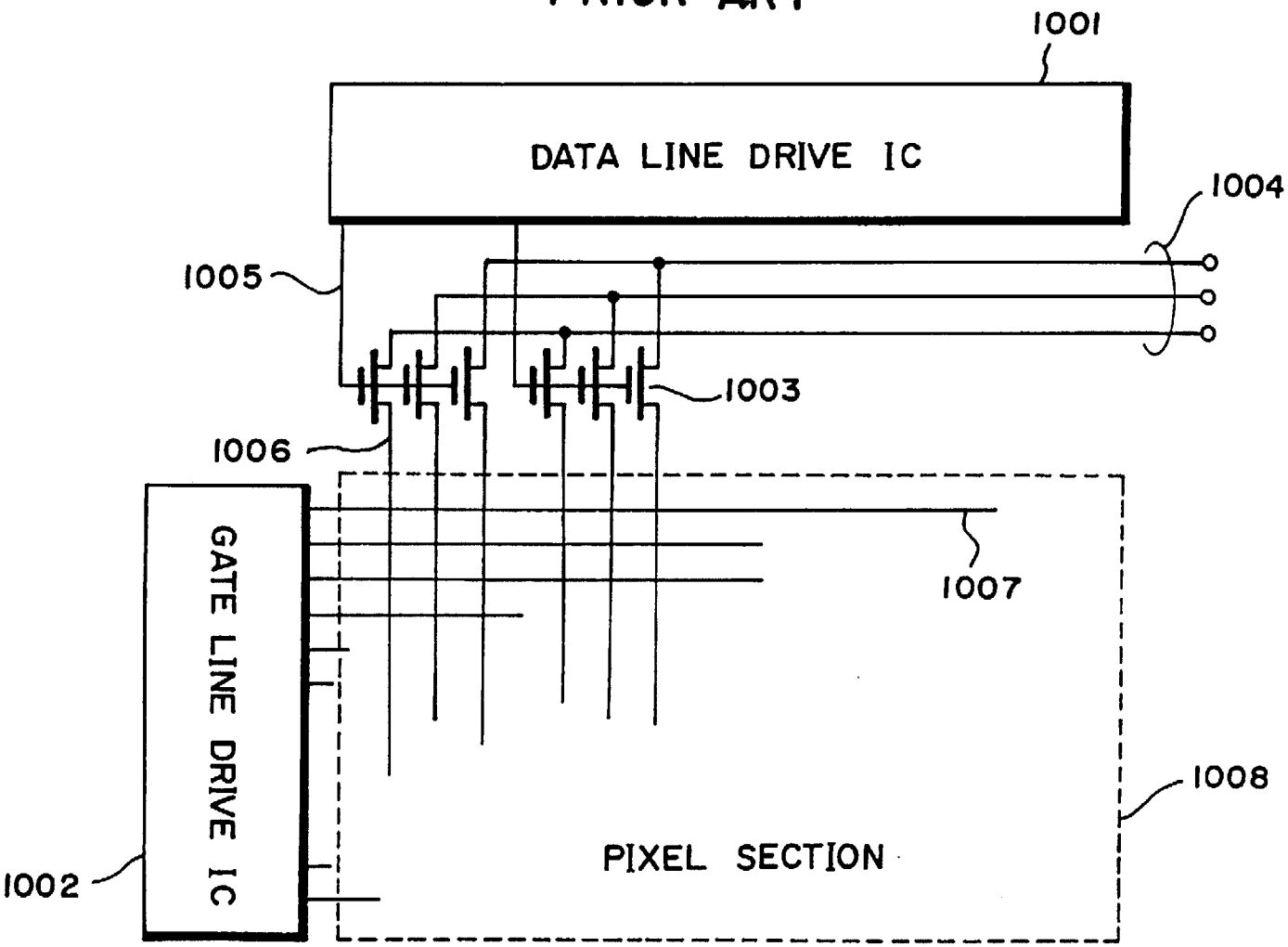
FIG. 10 PRIOR ART
FIG. 10 is a diagram showing a prior active matrix type liquid crystal display of a fully integrated driver circuit type using polycrystalline silicon thin film transistors.

FIG. 3 shows an arrangement in which offset detection circuits are provided in each data line drive IC. Referring to FIG. 3, designated at 301 is one data line drive IC which has a shift register 302 for scanning sample/hold circuits 303, buffer amplifiers 304 for the corresponding sample/hold circuits 303, and data lines 305 corresponding to the sample/hold circuits 303. The data lines 305 are connected to a pixel section having gate lines 312, thin film transistors 313, liquid crystal capacitors 314 and opposing electrodes 315. The circuit configuration explained heretobefore is the same as that of the prior art data line drive IC. FIG. 9 referred to before in explaining the prior art example illustrates a sample/hold circuit 303 and an associated buffer amplifier 304 shown in FIG. 3.

In this embodiment, in addition to the above elements, reference supply analog switches 306, voltage measurement circuits 307 and AND gates 309 for selecting the elements 307 are added. Designated at 310 are control signal line groups for controlling the sample/hold circuits 303 from the shift register 302, at 311 selecting signal lines of the voltage measurement circuits 307, at 316 a control signal line group for controlling the shift register 302, at 317 a video signal line, at 318 a signal line for selecting the execution or non-execution of voltage measurement, at 319 a signal line for on-off operating the reference voltage supply analog switches 306, at 320 a reference voltage line, and at 321 an output line of the voltage measurement circuits 307.

The measurement of offset of the output voltage from each buffer amplifier 304 is conducted in the following manner. First, a selection signal on the signal line 318 is turned "on" and the "on" signal is successively supplied to the selecting signal lines 311 from the shift register 302. As a result, the AND gate 309 to which both the "on" signals are applied turns "on" and the associated analog switch 308 for selecting also turns on. In this way, voltages are successively outputted to the signal line 321. Each voltage measurement circuit 307 is calibrated by applying a gate signal to the gate line 319 to turn on each reference voltage supply analog switch 306, applying a reference voltage from the reference voltage line 320 and observing the output of voltage measurement circuit 307.

Further, as described before in connection with FIG. 9, each sample/hold circuit 303 is a dual system. Therefore, where an offset difference occurs between the individual systems, two circuits for measurement and storage are necessary. Further, the calibration has to be done independently in the two systems.

FIG. 4 schematically shows an arrangement in which an offset measurement section is constituted by thin film transistors. Referring to FIG. 4, designated at 401 to 405 are elements at a pixel section, at 401 a gate line, at 402 thin film transistors, at 403 liquid crystal capacitors, at 404 opposing electrodes, and at 405 data lines. The remainder of the illustrated structure constitutes a thin film circuit for offset measurement. The data line drive circuit is formed near the other side of the pixel section, and it may be a drive IC or a thin film drive circuit. Designated at 406 is a control signal line for on-off operating the reference voltage supply analog switches 408, at 407 a reference voltage line, at 409 a voltage supply line for a voltage measurement circuit at 410 thin film transistors for voltage measurement, at 411 thin film transistors for selecting the voltage measurement line, at 412 gate lines for on-off operating the thin film transistors for each block, at 413 signal lines of the voltage measurement circuit, and at 414 current amplifiers.

Features of this example are that voltage detection is done by detecting current which flows through thin film transistor and that leads from the detectors are arranged in a matrix form to reduce the size of the scanning circuit.

FIG. 4 shows only three signal lines for the sake of simplicity of the description. When a voltage for turning on the thin film transistor 411 is applied to a block selection gate line 412, three thin film transistors 411 connected to this line are turned on. At this time, current which is dependent on the voltages on the voltage supply line 409 and the corresponding data line 405 is caused to flow through the three thin film transistors 410, 411 and associated signal line 413. This current is detected with the corresponding current amplifier 414. These three circuits operate simultaneously for voltage reading. When the voltage reading in one block is ended, the gate voltage on the gate line 414 of this block falls, and voltage is applied to the next block gate line 412. The above sequence of operations is iterated for signal detection in successive blocks. In this case, the scanning system connected to the gate lines 412 may be a shift register constituted by thin film transistors or, since the number of terminals is reduced by the matrix arrangement, it may be an external drive IC. Further, the employment of the matrix arrangement has an advantage of improving the speed of measurement.

FIG. 5 schematically shows an arrangement which has a voltage measurement circuit constituted by thin film transistors. In this case, however, the conventional drive IC is used for the data line drive circuit. In the example of FIG. 4, the data line drive circuit was provided on the opposite side to the voltage measurement circuit with respect to the pixel section. In this embodiment, the data line drive circuit and the voltage measurement circuit are provided on the same side with respect to the pixel section. In a highly sophisticated liquid crystal display, data line drive ICs have to be provided on both sides of the pixel section. This embodiment is effective for such arrangement.

Referring to FIG. 5, designated at 501 is an active matrix substrate. On this substrate, a pixel section comprising elements 502 to 506, connector electrodes 507 and voltage measurement circuits comprising elements 508 to 518 are formed. Designated at 502 is a gate line, at 503 thin film transistors in the pixel section, at 504 liquid crystal capacitors, at 505 opposing electrodes, and at 506 data lines. At 508 are analog switches for electrically separating the voltage measurement circuits from the pixel section, at 509 a signal line for on-off operating the analog switches 508, at 511 reference voltage supply analog switches, at 510 a signal line for on-off operating the analog switches 511, at 512 a reference voltage line, at 513 voltage measurement means, at 514 analog switches for selecting voltage measurement means, at 515 a signal line, at 516 a detection amplifier, at 517 a shift register, and at 518 a control line group for the shift register. The data lines 506 are connected via the connector electrodes to the data line drive IC.

For the connection between the connector electrodes 507 and the drive IC, usually a flexible printed circuit is used. It is a feature of this example that the connector electrodes 507 are provided on the side of the voltage measurement circuit with respect to the pixel section. This arrangement has an end of avoiding the crossing of the data lines 506 with the voltage and signal lines in the voltage measurement circuit. It permits avoiding crosstalk caused by unnecessary capacitive coupling.

Another feature is that the analog switches 508 are provided for electrically separating the voltage measurement circuit from the pixel section. These switches, along with the elimination of the capacitive coupling noted above, can make the voltage measurement circuit and the conventional active matrix substrate completely independent from each other. This is effective for the calibration of the voltage measurement circuits 513. That is, the influence of the output impedance of the data line drive IC is removed by separating the circuit. Usually, by supplying reference voltage through the analog switch 511, the data line voltage is forced to become the reference voltage. However, the above circuit is preferred from the view point of the protection of the output terminals of the data line drive IC.

FIG. 6 schematically shows an example of voltage correction circuit. Referring to FIG. 6, designated at 601 is a video signal generator for generating digitalized video signal, at 602 a memory for digitally storing offset data, at 603 an operational unit for shifting video signal to an extent corresponding to offset, at 604 a digital-to-analog (DA) converter, at 605 data line drive ICs, at 606 a pixel section, at 607 a measurement section, at 608 a detector, and at 609 an analog-to-digital (AD) converter. In the case of FIG. 2, the video signal and the offset were combined in analog with a differential amplifier. In this example, digital operation is adopted for the synthesis of signals, and then signal is corrected by way of digital-to-analog (DA) conversion.

In the method of driving according to the invention, the offset is measured while calibrating the voltage measurement circuit, and the video signal is calibrated by using the measured data. The offset may be measured only once at the time of the initial system adjustment so long as changes in the offset with temperature or time lapse give rise to no problem. Where the offset variations give rise to problems, however, the measurement is made as desired by making use of the blanking period. In the case where only a single measurement is sufficient, the detector 608 and the analog-to-digital (AD) converter 609 are disposed outside the system. Where the measurement is to be made every time, these elements are provided inside the system.

Figure 7A:
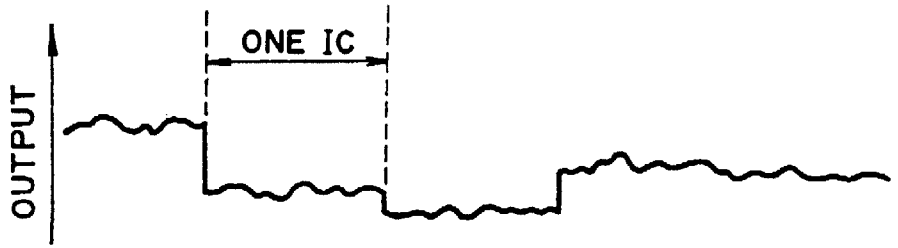
FIG. 7A PRIOR ART
FIGS. 7A–7D are diagrams comparing potential fluctuations in the prior art and those according to the invention.
Figure 7B:
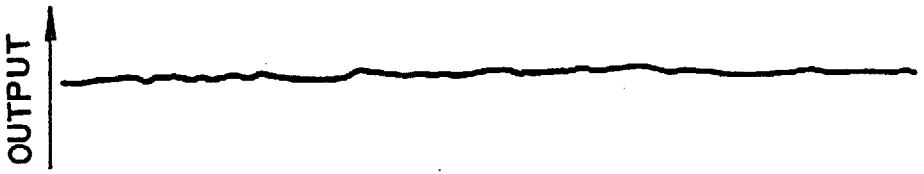

FIGS. 7A–7D are diagrams comparing potential fluctuations in the prior art and those according to the invention. Shown in FIG. 7A are data line offset fluctuations in a prior art active matrix type liquid crystal display using an active matrix type of non-crystalline silicon thin film transistors and drive ICs. The ordinate axis is taken for voltage, and the abscissa axis for data line position. The plot covers only part of the overall pattern. It will be seen that voltage fluctuations are small within one drive IC but are not so with the individual ICs. In this example, the fluctuations were ±30 mV in one IC but ±180 mV in the entire system. In contrast, with correction provided according to the invention, the overall voltage is very uniform as shown in FIG. 7B. In this case, the fluctuations were within ±5 mV.

Figure 7C:
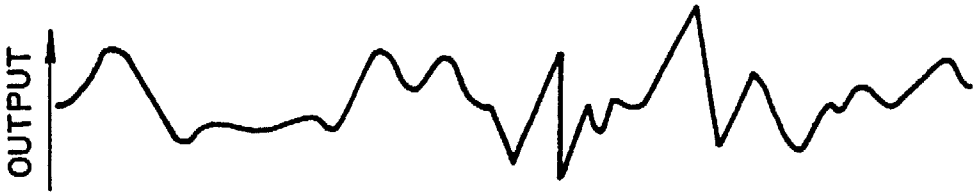
FIG. 7C PRIOR ART
Figure 7D:
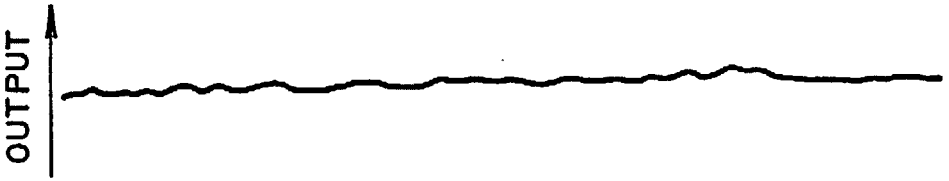
Figure 8:
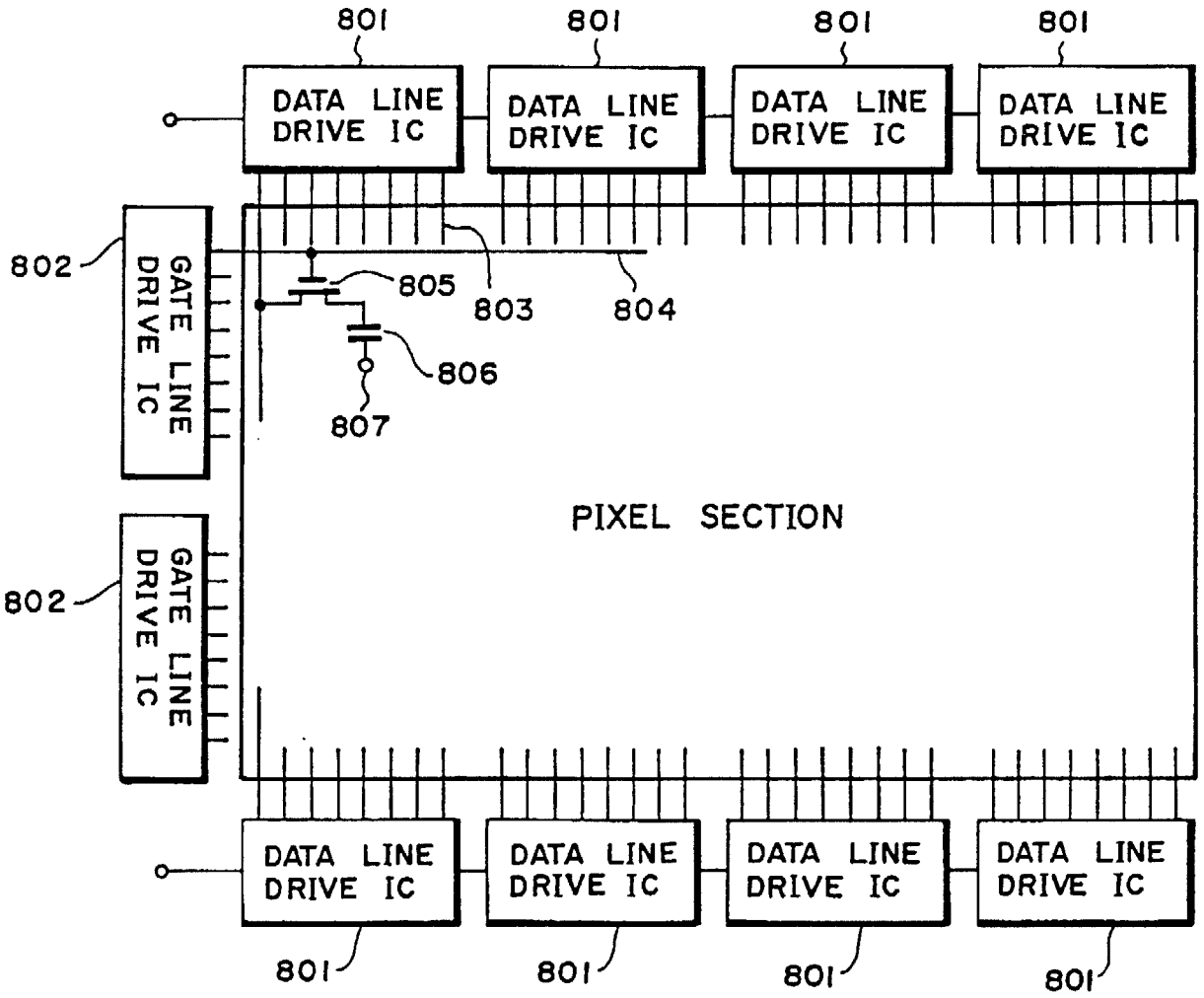
FIG. 8 PRIOR ART
FIG. 8 is a diagram showing an equivalent circuit of a panel section of a prior art active matrix type liquid crystal display.

Shown in FIG. 7C is an example of pattern in a fully integrated type drive circuit using polycrystalline silicon thin film transistors. In this case, there was no predetermined pattern. The fluctuations, however, were as great as ±400 mV. Shown in FIG. 7D is the result of correction of the voltage in FIG. 7C according to the invention. Again in this case, like the previous case, it was possible to suppress the fluctuations to below ±5 mV. In this case, a gradation number of 200 or above was realized to confirm the effectiveness of the invention.

As has been described in the foregoing, the offsets in the output voltages of the data line drive ICs and the thin film transistor drive circuits, which have heretofore been difficult to measure, can be measured accurately, and by correcting the offsets it is possible to realize a high gradation active matrix type liquid crystal display.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. An offset voltage detection circuit for use in a data line drive integrated circuit for driving an active matrix type liquid crystal display having a data line driver circuit connected to data lines of the active matrix, for outputting video signal to said data lines, said offset voltage detection circuit comprising:

a plurality of voltage detector circuits each connected to a respective one of said data lines for measuring voltage fluctuations on said data lines; and a plurality of reference voltage supply circuits each supplying a reference voltage to a respective one of said data lines for calibrating said plurality of voltage detector circuits, each of said reference voltage supply circuits including a respective switch connected to its respective data line, wherein each of said voltage detector circuits is serially connected to a signal line by an additional switch operated responsive to a first control signal to transfer output measurements from said respective voltage detector circuit to said signal line, and wherein said each respective switch operates responsive to a second control signal so as to supply said reference voltage to the respective one of said data lines.

2. The offset voltage detection circuit as recited in claim 1, wherein said first control signal comprises an output of an AND gate.

3. The offset voltage detection circuit as recited in claim 1, wherein said additional switch is a transistor.

* * * * *

UNITED STATES PATENT AND TRADEMARK OFFICE

CERTIFICATE OF CORRECTION

PATENT NO. : 5,751,279

DATED : May 12, 1998

INVENTOR(S) : Fujio Okumura

It is certified that error appears in the above-identified patent and that said Letters Patent is hereby corrected as shown below:

Column 2, line 56, change "258" to --256--.

Column 4, line 44, after "the" insert--embodiment of--.

Signed and Sealed this

Ninth Day of February, 1999

*Attest:*

*Acting Commissioner of Patents and Trademarks*

*Attesting Officer*